US009878198B2

(12) United States Patent
Johnson

(10) Patent No.: US 9,878,198 B2
(45) Date of Patent: Jan. 30, 2018

(54) WEIGHT LIFTING AND STRENGTH TRAINING PLATFORMS AND PULLING BLOCKS

(71) Applicant: Joshua E Johnson, Lincoln, NE (US)

(72) Inventor: Joshua E Johnson, Lincoln, NE (US)

(73) Assignee: FIVE RINGS DESIGN LLC, Lincoln, NE (US)

( * ) Notice: Subject to any disclaimer, the term of this patent is extended or adjusted under 35 U.S.C. 154(b) by 131 days.

(21) Appl. No.: 14/524,766

(22) Filed: Oct. 27, 2014

(65) Prior Publication Data

US 2015/0157892 A1 Jun. 11, 2015

Related U.S. Application Data

(60) Provisional application No. 61/896,094, filed on Oct. 27, 2013.

(51) Int. Cl.
*A63B 21/06* (2006.01)
*A63B 21/00* (2006.01)
(Continued)

(52) U.S. Cl.
CPC ..... *A63B 21/4029* (2015.10); *A63B 22/20* (2013.01); *A63B 23/047* (2013.01);
(Continued)

(58) Field of Classification Search
CPC ..... A63B 2225/09; A63B 2225/093; A63B 21/078; A63B 21/4027; A63B 21/4029; A63B 21/4031; A63B 21/4033; A63B 21/4034; A63B 21/0605; A63B 23/0458; A63B 23/1236; A63B 2210/50; A47B 7/02; A47B 9/14; A47B 87/02; A47B 87/0215
(Continued)

(56) References Cited

U.S. PATENT DOCUMENTS 2,253,777 A * 8/1941 Gipson ..... A47B 85/04 108/12
2,643,923 A * 6/1953 Beall ..... A47B 9/18 108/12
(Continued)

FOREIGN PATENT DOCUMENTS

CH 584017 A * 1/1997 ..... A47B 3/10
GB 2274773 A * 8/1994 ..... A47B 3/06

*Primary Examiner* — Gregory Winter
(74) *Attorney, Agent, or Firm* — Camille L. Urban; BrownWinick Law Firm

(57) ABSTRACT

A weight training tool includes a pair of adjustable platforms or blocks. Each block comprises a support platform and a plurality of legs, the legs configured to allow conversion of the platform to at least two heights, and collapse of the platform to a compact structure having wheels for ease of transport. The legs fit into mating tubes on the underside of the platform. To provide a second height, the legs may be equipped with a perpendicular portion to fit into mating tubes on the underside of the support platform to support the platform at a shorter height. One of each of the pair of platforms is equipped with a projection on its underside which can be detachably associated with a projection on the underside of the other platform with a space formed therebetween for storing legs. Attachable wheels and a handle complete the transportable platform pair.

4 Claims, 6 Drawing Sheets

(51) Int. Cl.
*A63B 22/20* (2006.01)
*A63B 23/04* (2006.01)
*A63B 71/02* (2006.01)

(52) U.S. Cl.
CPC ..... *A63B 23/0458* (2013.01); *A63B 21/06* (2013.01); *A63B 2071/025* (2013.01); *A63B 2210/50* (2013.01); *A63B 2225/093* (2013.01)

(58) Field of Classification Search
USPC ..... 108/19, 91, 147.2, 147.22, 12; 297/239, 297/256.11, 344.12; 248/161, 406.5, 248/163.1
See application file for complete search history.

(56) References Cited

U.S. PATENT DOCUMENTS 2,831,739 A * 4/1958 Fryckholm ..... A47B 9/08 126/304 A
3,229,790 A * 1/1966 Shayne ..... F16B 12/50 108/190
3,361,088 A * 1/1968 Hodgkin ..... A47B 9/00 108/12
4,106,413 A * 8/1978 Hoaglund ..... A47B 9/16 108/12
5,107,775 A * 4/1992 Langlais ..... A47B 9/14 108/147.21
5,248,286 A * 9/1993 Wilkinson ..... A47C 3/20 108/12
5,819,671 A * 10/1998 Ocampo ..... B23D 47/025 108/19
6,000,343 A * 12/1999 Laney ..... A47B 87/002 108/12
6,062,150 A * 5/2000 Sikora ..... A47B 87/0223 108/190
6,363,866 B1 * 4/2002 Schwartz ..... A47B 87/002 108/64
6,427,604 B1 * 8/2002 Chrobak ..... A47B 9/00 108/12
8,118,375 B2 * 2/2012 Berthiaume ..... A47B 9/14 108/147.21
2002/0153336 A1 * 10/2002 Wang ..... A47F 7/0028 211/60.1
2015/0090846 A1 * 4/2015 Crowley ..... F24F 13/32 248/188.5
2015/0196799 A1 * 7/2015 Chua ..... A63B 23/1236 482/141
2016/0015177 A1 * 1/2016 Blake ..... A47B 87/002 108/64

* cited by examiner

WEIGHT LIFTING AND STRENGTH TRAINING PLATFORMS AND PULLING BLOCKS

PRIORITY STATEMENT

This application is a utility application based off provisional application No. 61/896,094 filed on Oct. 27, 2013. The entire contents of which are herein incorporated by reference.

FIELD OF INVENTION

The present invention relates to body building in general and to the sport of weight lifting in particular. In order to safely practice the various movements required by the sport, weightlifters use blocks or boxes that allow the lifter to practice lifting from different heights and positions.

BACKGROUND

Weight lifting is an athletic discipline with an ancient history. For centuries, various populations have held competitions to determine who can lift the heaviest weight. Today's sport traces back to 19$^{th}$ century Europe, including the Olympic Games of 1896. Those who lift weights either within or outside the rules of the Olympic Games practice the sport. To do so effectively, various tools have been developed to conserve strength to allow for more practice lifts in a session.

Blocks have always been a staple of training in serious weightlifting gyms and Olympic training centers worldwide. They are an extremely effective training tool for new lifters in need of technical work, and veteran lifters working on technique refinement. Blocks provide a safe platform for both pulling/pushing and dropping the weight for the next lift without needing to go all the way back to the ground. This is not only convenient for the next lift, but it saves valuable time and energy when lifting heavy weight, and allows the lifter to focus on the intended training rather than re-lifting the weight from the ground before each repetition.

With the rapid proliferation of "functional fitness" movements, and the continued utilization of these training methods in university and high school athletic programs training, the Olympic Lift (clean, jerk, snatch) has become ever popular. The snatch requires the use of a very wide grip to pull the barbell overhead without pressing out with the arms. The clean and jerk uses a narrower grip to pull the bar to the shoulders and the push until the arms reach full extension without a press out. However, a vast majority of the training facilities promoting these lifts do not provide blocks or platforms in their set-ups. Traditional wooden blocks (though cost effective and strong) are heavy, cumbersome, and very inconvenient to store when not in use. Further, one must own a set of low blocks and a set of high blocks in order to be able to practice both lifts efficiently.

Newer steel constructed platforms are equally hard to store, and are generally offered with a fixed height, or limited range of height adjustability, also requiring two separate sets to be obtained for each high (pushing-jerk, press) and low (pulling-clean, snatch) training. These steel platforms are generally more expensive than wooden blocks.

What was needed was a set of platforms with at least the strength of wooden blocks that could be easily stored. What was also needed was a set of platforms configured to function at more than a single height, thereby negating the need for separate sets for every needed height. Further, the modern gym and home gym alike would benefit from a set of platforms that could be reduced in size for storage and equipped with means to make their transport simpler and easier. Finally, a block that could be converted for other uses such as for use as a sled for other training needs would offer additional benefits.

SUMMARY OF THE INVENTION

The purpose of the blocks in the new design described below is to provide a strong, height convertible and adjustable, portable, collapsible alternative to the bulky, heavy, difficult to transport and store blocks of the prior art.

This present block design includes a set of blocks each comprised, at least in part, of material that provides high strength to weight ratio such as, but not limited to, steel. Each block includes a top or platform and associated legs. The lower or under side of the platform includes means to associate the legs with the platform. In one embodiment, the means to associate the legs with the platform comprise short tubes mounted perpendicular to and on an underside of the platform. However, the short tubes could, conceivably, be replaced by studs or pegs with or without threads, or by protrusions equipped with a clamp for surrounding a leg and securing it. Any of a variety of possibilities might be used for associating the means to associate the legs with the legs including clamping mechanisms, openings and pins, with or without locking mechanism, friction fit, mating threads or telescopic sizing and positioning.

The legs are configured to allow each block in the set to convert from a tall platform position for pushing movements, to a low platform position (or several different lower platform positions) for pulling movements, allowing for one set of blocks to address all positions. In one embodiment, four legs of equal length are provided and are sized to be inserted into or otherwise associated with the means on the platform to associate the legs. Alternatively, the legs may be sized to accept the insertion of the means on the platform, or may be equipped with means to be detachably affixed to the means to associate. A fine height adjustment may also be provided so that the height of the platform may be more finely adjusted.

To accomplish a lower platform position or positions, four shorter legs may also be provided and fine height adjustment of that position may be provided in a similar way. Alternatively, instead of providing four shorter legs, each of the long legs may be outfitted with at least one perpendicular portion positioned and configured to be connected to the means to associate the legs. By using the perpendicular portion as the leg for supporting the platform, the platform can be supported at a low position or several different low positions. Employing a long leg configured in this way allows a single leg to be convertible from support for the high position to at least one low position. The perpendicular portion may likewise be provided with fine height adjustment means for the low position as previously described herein for the high position.

The present invention also provides unique structure to allow the set of blocks to be collapsed and associated for storage or transport. The two platform tops of the two blocks are associated with one another in such a manner that an open area is left therebetween which functions as a storage area for the removable legs. In one embodiment, the means to associate the legs on one platform of the set of blocks are sized to accept the means to associate the legs on the other platform in a telescoping relationship and secured thereto. In one embodiment, the set of blocks can be collapsed by a method that includes positioning the first platform with its lower side and means to associate the legs facing upwards, the legs from both blocks are laid on the underside of the first platform for storage, and preferably secured thereto. Then the second platform is positioned with its lower side facing downwards and aligned with the first platform. The first platform's and second platform's means to associate the legs are thereafter secured together, and retain the legs between in the space formed between them. An alternative embodiment includes means to secure the legs to the lower side of either platform and, thereafter, each block may be transported singly. Alternatively, the collapsed blocks may be associated with each other; in this embodiment, the second platform to which legs have been secured is positioned with its lower side facing downwards and aligned with the first platform. The first platform's and second platform's means to associate the legs are thereafter secured together In one embodiment, one or both platforms are equipped with a lip perpendicular to, and located near the perimeter of the platform so that when in the collapsed form as described, the lip substantially or partially encloses the storage area. A handle or handles to aid in transporting the compact blocks in their collapsed form may also be provided on one or both platforms.

In yet another embodiment, transport means are provided. Said transport means may comprise at least one wheel positioned on a platform or on means to associate the legs to provide ease of movement of the blocks in its collapsed position. Alternatively, a detachable wheel or wheels are provided and at least one of the platforms or means to associate the legs is equipped with means to attach the wheel to provide ease of transport. When not in use, the wheels may optionally be secured to the lower side of a platform.

In still another embodiment, each block may be provided with a plurality of braces. A brace may be associated with two legs thereby providing stability to the block when in use. Alternatively, a brace may be associated with the lower side of a platform and at least one leg. In any event, the lower side of the block's platform may be provided with means to secure the plurality of braces when in collapsed form.

In still another embodiment, a sled kit is provided. The kit is used to convert a block to a sled, specifically, the kit includes means to attach at least one sliding surface detachably to the upper side of the platform; the block is then inverted so that the lower side of the platform is facing upward and the sliding surface of the kit is on the floor. The sled kit consists of upright handle attachments for pushing, a center post to hold any additional weights placed on the sled, and a set of "skis" equipped with the sliding surface. The skis are locked onto the inverted decks using threaded fasteners or other means to secure them. The sliding surface is preferably equipped with replaceable sliding materials, for example, a plastic composite attached to their bottoms to reduce wear and friction and allow the sleds to be used on rough surfaces like concrete or asphalt. The platforms also have several attachment points around them to be used in conjunction with ropes or harnesses for pulling training.

For use of the sled embodiment, two long legs may remain attached to the lower side of the platform, or, if not already attached, two long legs are attached to the lower side of the platform which is facing upward thereby providing hand holds for the user; the remaining legs and braces may then be secured to the lower side of the platform where they remain during use of the sled. A user pushes on the legs to slide the sliding surface along the floor. Weight may be added to the sled as needed. A center post may be provided and associated with the sled to allow weights to be secured.

DETAILED DESCRIPTION OF THE INVENTION

Figure 1:
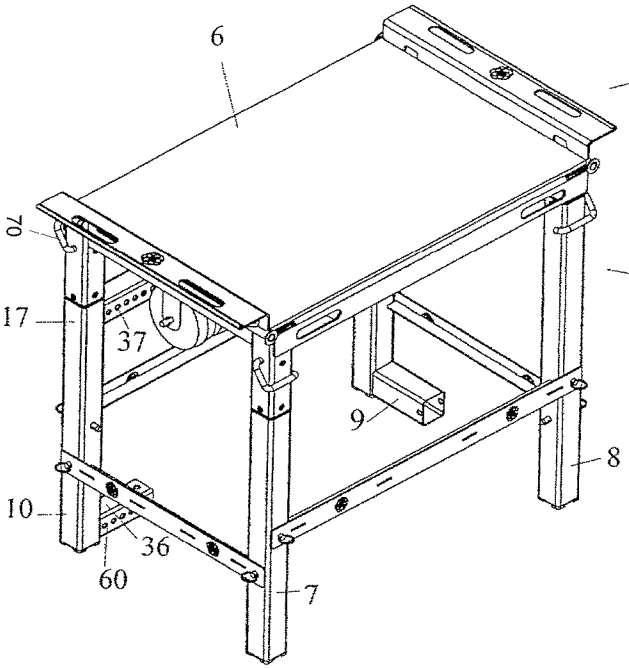
FIG. 1 is a first perspective view of a block of the present invention from a first end configured in a high position
Figure 2:
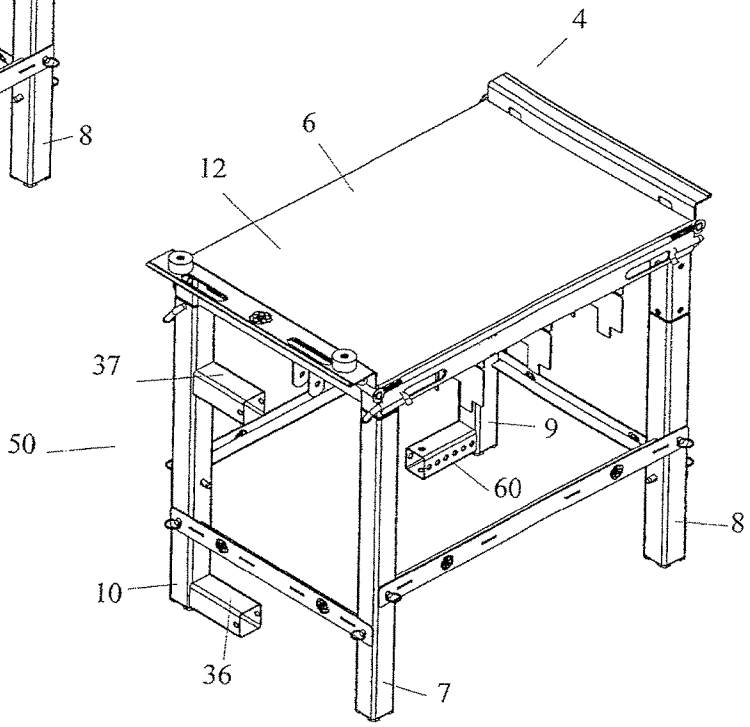
FIG. 2 is a second perspective view of a block of the present invention from a second end configured in a high position
Figure 4:
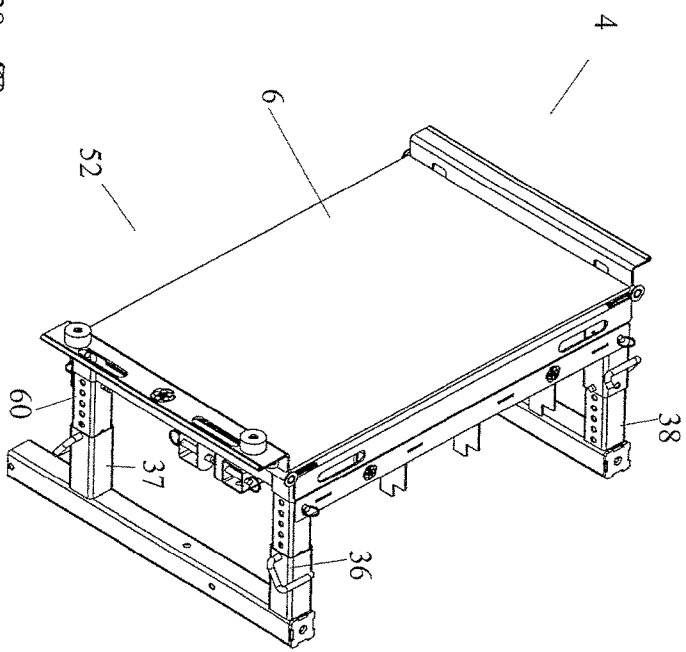
FIG. 4 is a first perspective view of a block of the present invention from a first end configured in a low position

The purpose of the blocks 2,4 in the new design described below is to provide a pair of blocks which are strong, height convertible and adjustable, and are portable and collapsible.

This present block design includes a set of blocks 2, 4 each comprised, at least in part, of material that provides high strength to weight ratio such as, but not limited to, steel. Each block 2, 4 includes a top or platform 6 and a plurality of legs, preferably, but not necessarily limited to, four legs 7, 8, 9, 10. The platform 6 of each block 2, 4 comprises an upper side 12 and a lower or underside 14. The lower side 14 includes means to associate the legs 16. In one embodiment, said means to associate the legs 16 with the platform 6 comprise a plurality of short tubes 17 mounted perpendicular to and on the underside 14 of the platform 6. The legs 7-10 are configured to allow each block 2,4 in the set to convert from a tall platform position 52 for pushing movements, to a low platform position 50 for pulling movements, allowing for one set of blocks to address all positions. In one embodiment the four legs 7-10 are of equal length and are sized to be inserted into the means on the platform to associate the legs 16, to accept the insertion of the means to associate on the platform 16, or to be detachably affixed to the means to associate 16. A fine height adjustment means 60 may also be provided so that the height of the platform may be more finely adjusted within its low platform 52 position or its high platform position 50, specifically, at least one openings 20 in one or more of the legs 7-10 and in said means to associate the legs 16 may be aligned and secured. Such securement 70 might comprise a pin and locking mechanism. Alternatively, a clamping or locking mechanism might be provided or slide in plates may be employed to block relative movement of the short tubes 17 and the legs 7-10. In a second embodiment, to accomplish the low platform position 50, four shorter legs may be provided to be used interchangeably with the longer legs 7-10 and fine height adjustment may be provided in a similar way. Alternatively, instead of providing four shorter legs, the legs may be outfitted with at least one perpendicular portion 36-39 positioned and sized to receive or to be received by or otherwise be associated with said means to associate the legs 16. By using the at least one perpendicular portion 36-39 as the leg for supporting the platform 6, the platform 6 can be supported at the low position 50. Employing a single leg for both positions in this way can provide support for both the high position 52 and the low position 50. Further, the at least one perpendicular portion 36-39 may likewise be provided with fine height adjustment means 60 for the low position 50 as previously described herein for the high position 52. The height adjustment mechanism 60 may include a telescoping sleeve/insert design, or other means of repositioning relative portions of the platform 6 and the legs 7-10 relative to one another, for example, aligning holes and pegs, or slide in plates, or threads and mating threads. There are many other possible ways to secure and reposition the platform 6 and legs 7-10 known by those of skill in the art and are not meant to be excluded by this description. The position may, alternatively, be secured by clamp or biasing means, or simply by buttressing against another portion of the block platform or leg, providing height adjustability and fine tuning of the platform for specific individuals and lifts.

Figure 5:
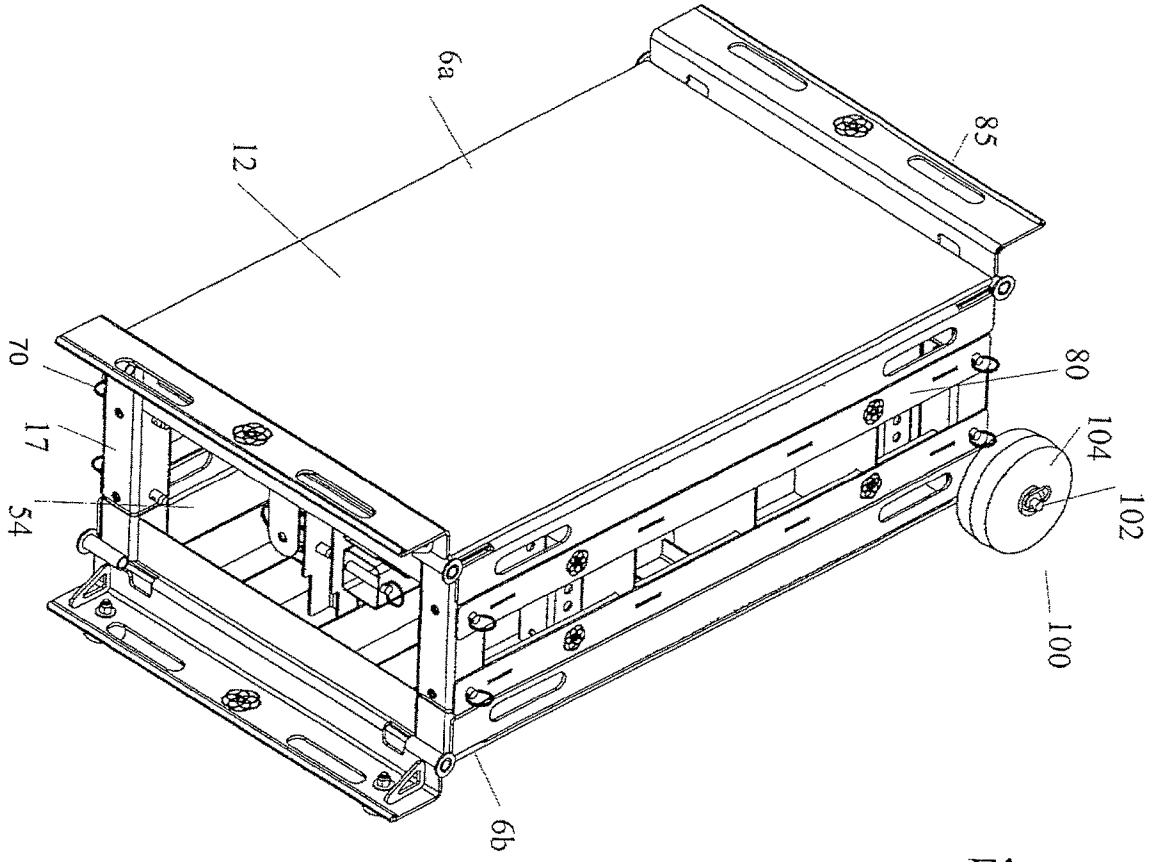
FIG. 5 is a perspective of the pair of blocks in collapsed form.
Figure 6:
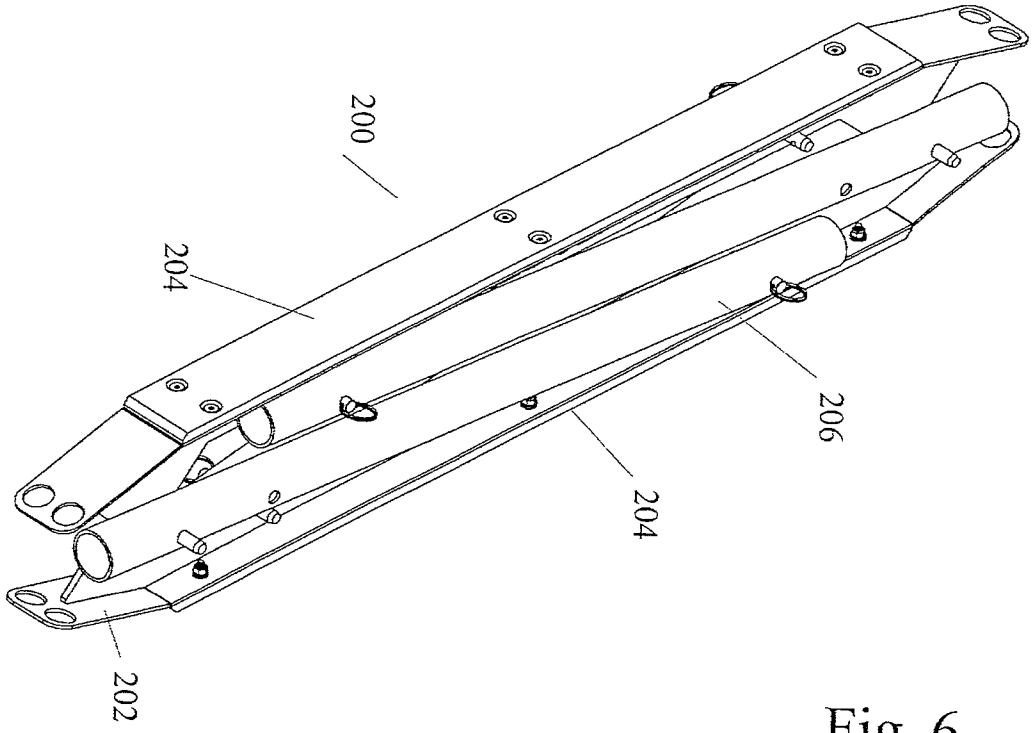
FIG. 6 is a perspective of a sled kit.
Figure 7:
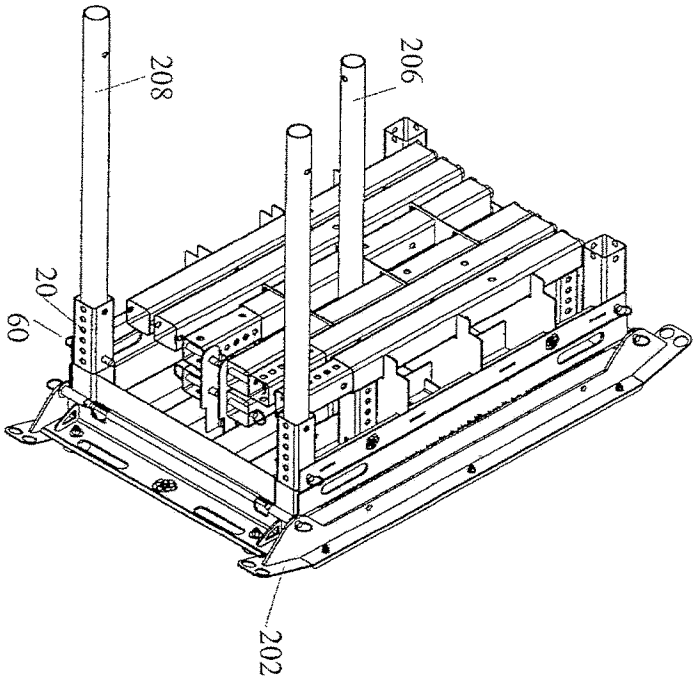
FIG. 7 is a perspective showing the sled kit mounted on a block, hand holds, a center post, and legs detached and secured on the underside of the platform.
Figure 10:
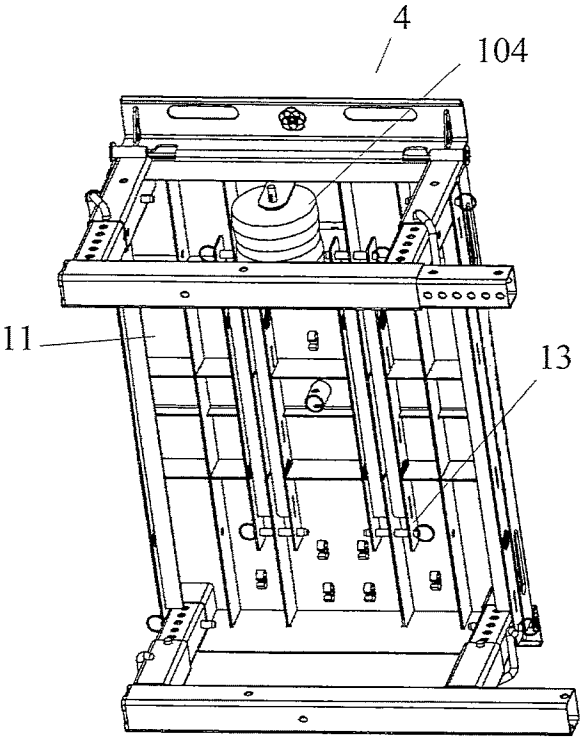
FIG. 10 is a perspective showing the second block of the pair, assembled, configure in a low position, showing wheels and securing mechanisms on the underside of the platform.
Figure 9:
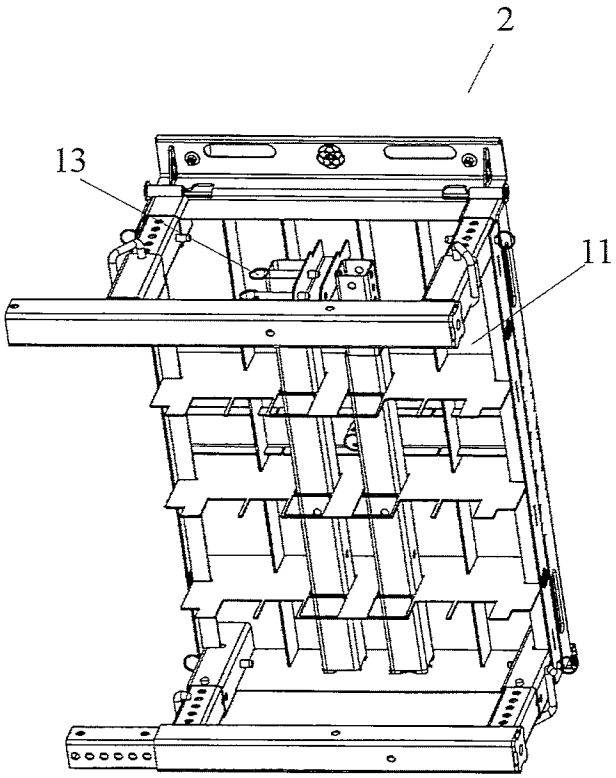
FIG. 9 is a perspective showing the first block of a pair, assembled, configured in a low position, two long legs stored on the underside or the platform.

The present invention also provides unique structure to allow the set of blocks 2, 4 to be collapsed and associated for storage or transport (see FIGS. 5, 6 and 7). In the following description, the elements of block 2 are described with the letter "a" and the elements of block 4 are described with the letter "b". The platforms 6*a*, 6*b* are associated with one another in such a manner that the association provides an open area 54 therebetween which functions as a storage area for the removable legs 7-10 of platform 6*a* and legs 7-10 of platform 6*b* and, in some embodiments, short legs 26-29 of platform 6*a* and 26-29 of platform 6*b*. In one embodiment, the means to associate 17 the legs 16 on one platform 6*a* of the set of blocks 2, 4 are sized to accept the means to associate 17 the legs 16 on the other platform of the set of blocks thereby forming a telescoping relationship. The means to associate the legs 16 from both platforms 6*a* and 6*b* can be secured relative to one another by any of a number of securement means 70 including clamps, openings through which a locking pin is inserted, nuts and bolts, etc. In use of a first embodiment, the first platform 6*a* is positioned with its lower side 14*a* and means to associate 17 the legs 16 facing upwards, the legs 26-29 of platform 6*a* and 26-29 of platform 6*b* are laid on the underside 14*a* of the first platform 6*a* and may be secured thereto by screws, clamps, openings and pins, etc. (see FIG. 9) and then the second platform 6*b* is positioned with its lower side 14*b* facing downwards and its means to associate the legs 16*b* aligned with the first platform's 6*a* means to associate the legs 16*a* (see FIG. 5). The first platform's 6*a* and second platform's 6*b* means to associate the legs 16*a* and 16*b*, respectively, are thereafter secured together thereby retaining the legs 7-10 of each platform 6*a* and 6*b*, and optionally short legs 26-29 of each platform 6*a* and 6*b* between the first 6*a* and second 6*b* platform (FIG. 5). Means to associate the legs 16*a* and 16*b* on each platform may be associated together via telescopic relationship or adjacent relationship, in either case secured by the securement 70. The securement may include one or a plurality of openings and pins, clamping mechanism, friction fit, or other mechanisms known in the art. In one embodiment, the underside 11 of each platform 6*a* and 6*b* comprises means to secure 13 a leg 7-10. In one embodiment, one or both platforms 6*a*, 6*b* are equipped with a lip 80 perpendicular to the platform 6*a* and/or 6*b* and positioned so that when in the collapsed form as described above, the lip 80 substantially or partially encloses the open or storage area 54. A handle 85 or handles to aid in transporting the compact blocks in their collapsed form may also be provided on one or both platforms 6*a*, 6*b*.

Figure 3:
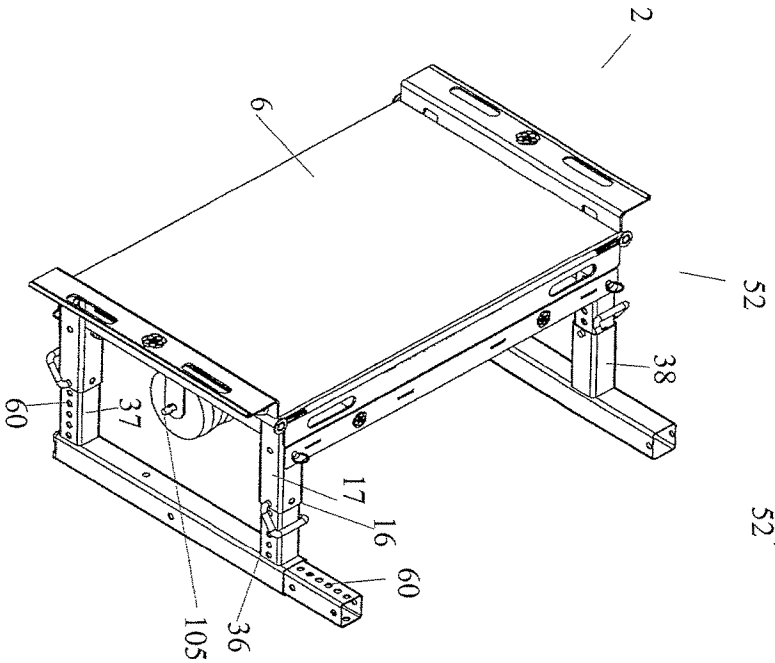
FIG. 3 is a first perspective view of a block of the present invention from a first end configured in a low position
Figure 8:
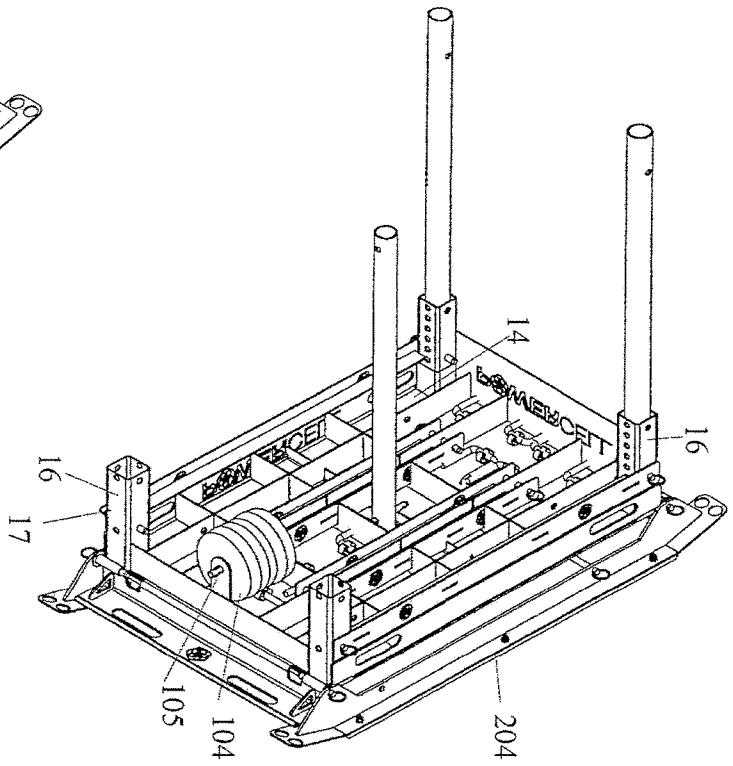
FIG. 8 is a perspective showing a sled kit mounted on a block, hand holds, and a center post.

In yet another embodiment, transport means 100 are provided (see FIG. 5). Said transport means 100 may comprise at least one wheel 104 positioned on a platform 6*a* or 6*b*, imbedded in a platform 6*a* or 6*b*, or positioned on means to associate the legs 16*a*, 16*b* to provide ease of movement of the blocks 2,4 in their collapsed position. Alternatively, a detachable wheel 104 or wheels are provided and at least one of the platforms 6*a* or 6*b* or means to associate the legs 16*a* or 16*b* is equipped with means to attach the wheel 102 to provide ease of transport. One embodiment includes means to store 105 the detachable wheels 104 when the blocks are in use (see FIGS. 3, 8).

One individual can move the collapsed set of blocks 2,4 into place as one piece and assemble it. In one embodiment, the block set comprises assembly of two blocks 2, 4 (1 per side) at a desired high 52 or low 50 adjustable height position. The user may utilize the platforms as traditional wooden or steel blocks/platforms. When finished, the user can break the blocks 2,4 down, associate them in the collapsed form as described herein into the rolling unit (FIG. 5) and transport it easily to the desired storage location, where it can rest vertically or horizontally, taking up minimal space. As many as six of these complete rolling units can occupy the same space as one traditional set of wooden blocks or steel platforms.

In an alternative embodiment, the underside 11 of each block 2 and 4 is equipped with means to secure 13 a leg or legs 7-10 thereto and may or may not also be equipped with transport means 100 which may include a wheel 102 so that each block may be separately disassembled and transported without association with the other block.

The block 2 or 4 may, further, be converted to a weight training sled (see FIG. 7, 8). In this embodiment, a ski attachment assembly 200 (FIG. 6) is provided and attached to the upper side 12 of the platform 6. The ski attachment assembly 200 includes a ski 204 having at least one angled end 202 to facilitate sliding. The assembly 200 may also include a center post 206 and/or hand holds 208. The platform 6 is inverted onto its upper side 12 to place the ski 204 on the floor. Preferably, the hand holds 208 are secured with means to associate legs 16 to serve as pushing or hold bars. In one embodiment, the center post 206 is secured by a center post securement. Weights may then be threaded onto the center post 206 so the user can adjust the weight on the sled. In one embodiment, the center post 206 and the hand holds 208 can be provided by the legs 7-10.

Possible additional uses of the blocks include use as platforms for plyometric jumping and landing exercises as well as using the blocks for a weight supporting rack for squats or similar exercises.

I claim:

1. A block for weight lifting training, said block convertible from a high position to at least two low positions and comprising:

at least one platform;

a first short tube extending from the at least one platform;

a second short tube extending from the at least one platform; and at least two legs, each of said at least two legs having a first end configured to connect to the first short tube to provide the high position, a first fine adjustment means extending from each leg, and a second fine adjustment means extending from each leg, wherein the first fine adjustment means is configured to connect to the first short tube and the second fine adjustment means is configured to connect to the second short tube thereby providing the at least two low positions.

2. The block of claim 1, wherein the first and second fine adjustment means include at least one hole and the first and second short tubes include at least one hole.

3. The block of claim 2 further comprising a pin insertable into the at least one hole of the first and second fine adjustment means and the at least one hole of the first and second short tubes.

4. The block of claim 1, the first fine adjustment means configured to telescopingly engage the first short tube, and the second fine adjustment means configured to telescopingly engage the second short tube.

* * * * *